US005092681A

United States Patent [19]

Ashley, III

[11] Patent Number: 5,092,681

[45] Date of Patent: Mar. 3, 1992

[54] DRAWSTRING TRASH CONTAINER

[76] Inventor: William G. Ashley, III, 217 W. Union, Minden, La. 71055

[21] Appl. No.: 612,500

[22] Filed: Nov. 10, 1990

[51] Int. Cl.[5] ..... B65D 30/22; B65D 33/28

[52] U.S. Cl. ..... 383/4; 383/72; 383/76

[58] Field of Search ..... 383/4, 72, 75, 76, 74; 493/225

[56] References Cited

U.S. PATENT DOCUMENTS

| | | | |
|---|---|---|---|
| 931,627 | 8/1909 | Hrebelianovich | 383/72 |
| 1,351,388 | 8/1920 | Kabaci | 383/74 |
| 1,688,288 | 10/1928 | Rogers | 383/75 |
| 2,479,203 | 8/1949 | Brown | 383/4 |
| 2,551,044 | 5/1951 | Ottinger et al. | 493/225 |
| 2,678,672 | 5/1954 | Spilman | 383/76 |
| 2,691,998 | 10/1954 | Stucker | 383/72 |
| 2,710,639 | 6/1955 | Farls | 383/76 |
| 2,740,445 | 4/1956 | Fornell | 383/75 |
| 2,747,636 | 5/1956 | Couture | 383/76 |
| 2,871,900 | 2/1959 | Auditore | 383/4 |
| 2,970,630 | 2/1961 | Larsen et al. | 383/72 |
| 3,599,690 | 8/1971 | Christie | 383/72 |
| 3,653,583 | 4/1972 | Meyer | 383/75 |
| 4,337,812 | 7/1982 | Trinkner | 383/75 |
| 4,573,204 | 2/1986 | Polett | 383/74 |
| 4,739,880 | 4/1988 | Sawyer et al. | 383/72 |
| 4,944,393 | 7/1990 | Cappuzzo et al. | 383/75 |
| 4,991,978 | 2/1991 | Ostrowski | 383/4 |

FOREIGN PATENT DOCUMENTS

| | | | |
|---|---|---|---|
| 209927 | 8/1940 | Switzerland | 383/72 |

*Primary Examiner*—Gary E. Elkins
*Attorney, Agent, or Firm*—John M. Harrison

[57] ABSTRACT

A drawstring trash container which is characterized by a sheet of flexible, resilient material such as plastic, having a selected thickness and provided with peripheral loops, slits or a continuous channel for receiving a drawstring. The drawstring trash container is designed to be placed flat on the ground or other supporting surface, loaded with trash such as leaves and the like, and the drawstring tightened in the loops, slits or channel to secure the trash in the resulting bag. The drawstring ends may then be tied to secure the drawstring trash container for storage or trash pick-up.

2 Claims, 1 Drawing Sheet

DRAWSTRING TRASH CONTAINER

BACKGROUND OF THE INVENTION

1. Field of the Invention

This invention relates to trash containers such as trash bags and the like and more particularly, to a drawstring trash container which is characterized in a preferred embodiment by a round sheet of flexible, resilient material such as plastic having a selected thickness, with loops, panel slits or a continuous channel provided in or near the periphery thereof for receiving drawstring. The resilient sheet is first deployed on the ground or other surface and trash such as leaves, weeds and the like is deposited on the sheet, after which the drawstring ends are tightened to slide it through the loops panel slits or continuous channel which are gathered to contain the trash in the resulting bag. The ends of the drawstring may then be tied to close the gathered bag mouth and further secure the trash inside the newly created bag structure. The drawstring securing means for the drawstring trash container may include tab loops attached to the periphery of the resilient sheet, slits provided in spaced relationship near the periphery of the sheet, extension loops extending integrally from the periphery of the sheet, folded back on the sheet and secured, and a continuous drawstring channel formed in similar fashion by folding the peripheral edge of the flexible sheet material back on itself and sewing, gluing or attaching the folded edge by means of a sonic weld or similar technique, depending upon the material of construction chosen for the sheet.

2. Description of the Prior Art

Collection of trash such as leaves, weeds, pine straw and the like is normally effected using large plastic collection bags which may be packaged individually in containers or stored on a continuous roll, to be stripped from the roll at perforations provided in spaced relationship on the roll. Alternatively, the bags may be packaged individually in plastic sheaths or other packaging and some collection bags are provided with drawstrings at the mouth thereof, for closing the mouth and securing the contents after the trash is deposited therein.

One of the problems realized with conventional trash bags and particularly, the thin, plastic trash bags which are commonly provided on a continuous roll separated by bag perforations, is that of determining which end of the plastic bag is sealed when the bag is torn from the roll and opened for depositing trash. The sides of the bag are normally tightly pressed together with a "static cling" effect, which is accentuated when the bags are continuously rolled. Consequently, considerable time is sometimes spent trying to determine which end of the bag should be opened to receive the trash. Another problem is that of fully opening and deploying the plastic bag in a convenient configuration while depositing the trash, to prevent much of the trash from falling on the ground outside the bag. The bag is far too limp to be self-supporting and various types of supports and hangers, or a second person must therefore be used to support the bag with the open mouth configured to receive the trash. Other techniques include the use of plastic inserts which fit in the mouth of the bag for holding the mouth open during the depositing of trash. It is noted that all of these techniques require not only the bag itself for receiving the trash but also a helper or a positioning aid of various design for either supporting the bag in an upright configuration with the mouth open, or opening the mouth itself to receive the trash during trash collection.

Various types of bags and coverings have been designed to protect such items as Christmas trees and the like, and for collecting trash. U.S. Pat. No. 2,911,025, dated Nov. 3, 1959, to M. Paros, details a "Combination Christmas Tree Cover and Needle Catcher" for fitting over a Christmas tree and catching dry needles from the Christmas tree as the tree ages. A "Leaf Handling Device" is detailed in U.S. Pat. No. 3,355,187, dated Nov. 28, 1967, to M. Brindle. The leaf handling device includes an elongated, flat strip of material having a rope at one end and placed flat on the ground or other surface for receiving and collecting trash. U.S. Pat. No. 4,434,829, dated Mar. 6, 1984, to Robert L. Barnard, details a "Collapsible Yard Pan". The collapsible yard pan includes a rigid frame covered with a pliable fabric or plastic film which is contoured to form a portable bag-like container that can be opened along one side and having an end which lies flat for easy filling. The bag may be opened to receive trash, closed to enclose the trash and finally reopened at one end to allow the contents of the bag to be emptied. U.S. Pat. No. 4,471,600, dated Sept. 18, 1984, to Daniel W. Dunleavy, details a "Leaf Bagging Equipment and Method". The leaf collecting and bag assembly includes a plastic bag having an open end and a square or rectangular interval sheet attached to the open end of the bag and having an opening which communicates with the bag. The bag and sheet are laid flat on the ground, leaves or other trash are raked or otherwise collected on the interval sheet and the leaves are then directed into the underlying bag by raising the corners of the interval sheet. A "Method and Means of Bagging Loose Trash" is detailed in U.S. Pat. No. 4,519,183, dated May 28, 1985, to Ross Parody. A sheet of flexible material such as fabric or plastic is provided with flaps, loops and ties so that it can be positioned over a pile of loose material, with rigid sticks attached to the loops along two parallel edges of the sheet. The rigid sticks may be grasped by the user and forced together between the surface and the material, forming an open-ended envelope containing the material, which envelope is then turned over and flaps at the end of the envelope secured and tied over the ends to close the envelope, while the two sides made rigid by the sticks are tied together. The sticks may then be removed, leaving the flexible sheet formed into an envelope that encloses the material. U.S. Pat. No. 4,561,480, dated Dec. 31, 1985, to S. C. Underwood, details a "Leaf Caddy". The leaf caddy includes an upper rim constructed of a light-weight, strong, flexible material, the rim including a pair of first and second thin, flexible rods connected to a bowl-shaped, flexible material such as plastic. The flexible rods are designed to deploy into a circular configuration, forming a bowl for receiving trash or other material to be collected and subsequently closed to enclose the trash or other material therein. A "Disposable Apparatus for the Collection of Refuse" is detailed in U.S. Pat. No. 4,738,477, dated Apr. 19, 1988, to Mark C. Grossmeyer. The device includes a sheet-like member for placement upon a surface, which sheet-like member is devoid of apertures and defines a regular geometric shape. In one embodiment the device includes multiple disposable securing stakes or adhesive pads attached at the corners thereof for securing a member to the surface during the collection of refuse. The corners are attached to one another by a tie for disposal of the member, the securing stakes or the adhesive pads and the refuse collected thereon.

It is an object of this invention to provide a drawstring trash container which is characterized by a thin, flexible sheet fitted with a drawstring at or near the periphery thereof for deployment flat on the ground or other supporting surface, receiving trash or other material for collection and enclosure of the trash or other material by tightening the drawstring and gathering and shaping the flexible sheet into a bag-like structure.

Another object of this invention is to provide a drawstring trash container which includes a round, resilient plastic or fabric material fitted with tab loops, slits, extension loops or a drawstring channel at or near the periphery thereof for slidably receiving a drawstring, wherein the drawstring trash container may be deployed flat on the ground or other supporting surface for receiving trash or other material. The ends of the drawstring are then tightened to define a bag for containing the trash or other material after collection.

Still another object of this invention is to provide a drawstring trash container which includes a round plastic sheet of selected thickness, flexibility, resiliency and diameter, with tab loops, slits, extension loops or a drawstring channel provided in or near the periphery of the plastic sheet for receiving a drawstring in sliding relationship wherein the sheet may be initially deployed flat on the ground or other supporting surface, trash or other material placed o the plastic sheet and the drawstring subsequently tightened and extended through the tab loops, panel slits, extension loops or drawstring channel to close the periphery of the plastic sheet and define a bag for enclosing the trash or other material.

SUMMARY OF THE INVENTION

These and other objects of the invention are provided in a new and improved drawstring trash container which is characterized by a thin, round, flexible and resilient plastic sheet of selected diameter, with tab loops, parallel slits or a continuous drawstring channel provided in the periphery of the plastic sheet for receiving a drawstring, wherein the plastic sheet and the drawstring may be deployed in a planar configuration for receiving trash or other material and the drawstring then gathered through the tab loops, parallel slits or continuous channel to gather the tab loops, slits or channel and enclose the trash or other material in a bag-like structure for storage or disposal.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4, 5, 6, 7, 8:
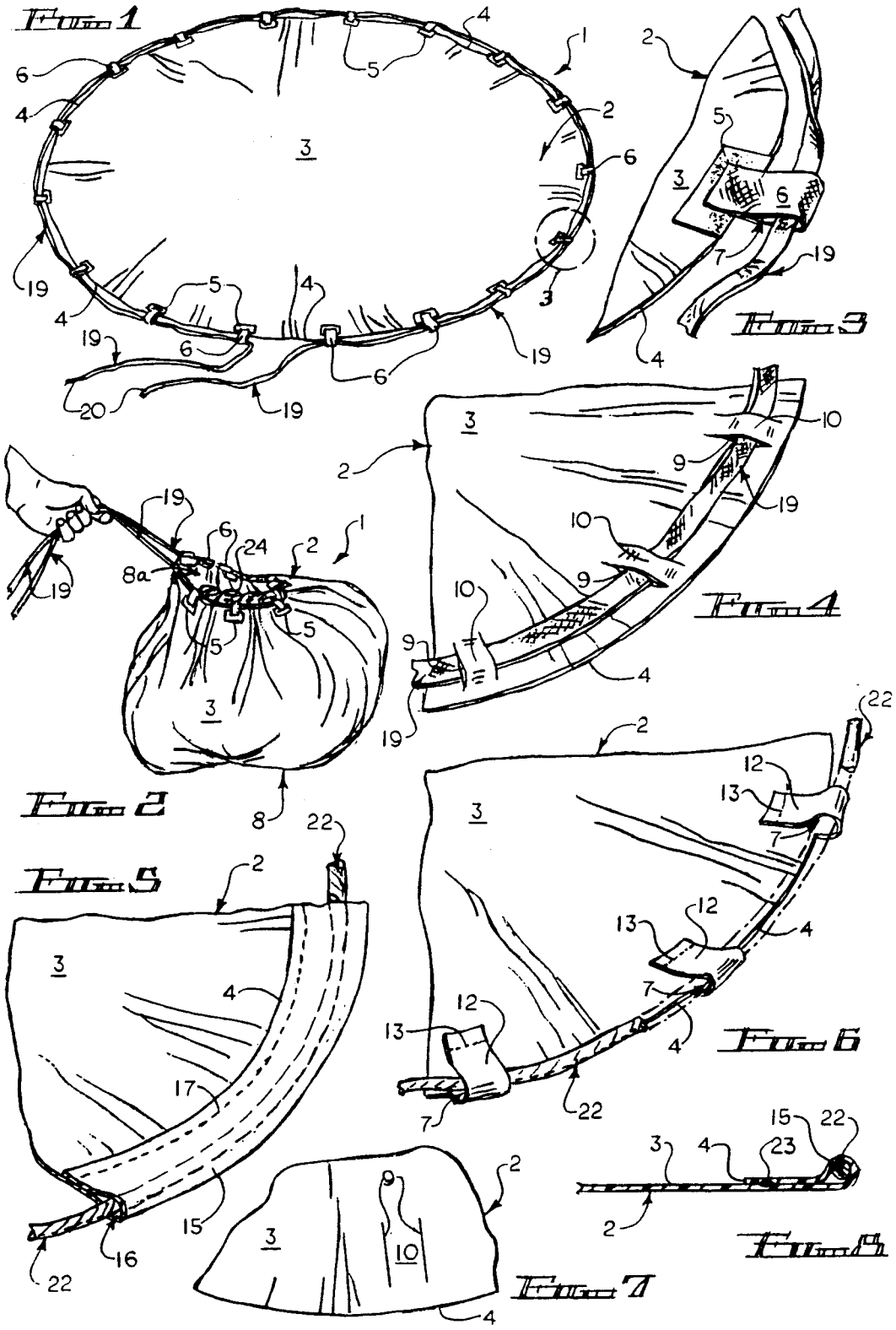
FIG. 1 is a perspective view of a preferred embodiment of the drawstring trash container in planar, deployed configuration ready to receive trash or other material.
FIG. 2 is a perspective view of the drawstring trash container illustrated in FIG. 1 in gathered configuration, wherein the plastic sheet defines a bag for enclosing and containing the trash.
FIG. 3 is an enlarged sectional view of a preferred panel mount tab and tab loop configuration in the drawstring trash container illustrated in FIG. 1, for slidably receiving a drawstring.
FIG. 4 is another enlarged segment of a portion of the plastic sheet illustrated in FIG. 1, more particularly illustrating an alternative bag slit and slit segment configuration for slidably receiving a drawstring.
FIG. 5 is yet another enlarged sectional view of a portion of the plastic sheet illustrated in FIG. 1, more particularly illustrating another alternative drawstring channel configuration for receiving a rope or cord drawstring.
FIG. 6 is still another enlarged sectional view of a portion of the plastic sheet illustrated in FIG. 1, more particularly illustrating yet another alternative panel extension loop configuration for slidably receiving a rope or cord drawstring.
FIG. 7 is a top view of the sheet segment illustrated in FIG. 4, more particularly illustrating the preferred parallel panel slit and slit segment embodiment of the invention with the drawstring removed.
FIG. 8 is a sectional view of the drawstring channel embodiment illustrated in FIG. 5 and the panel extension loop embodiment illustrated in FIG. 6, more particularly illustrating a sonic weld for alternatively securing either the panel extension loops or the drawstring channel elements of the drawstring trash container.

Referring initially to FIGS. 1 and 3 of the drawings, in a preferred embodiment of the invention the drawstring trash container is configured in deployed configuration and is illustrated by reference numeral 1. The drawstring trash container 1 is characterized by a flexible resilient plastic sheet 2, defined by a round panel 3 and terminated at a circular panel periphery 4. Multiple panel mount tabs 5 are secured to the round panel 3 just inside the panel periphery 4 for reinforcing purposes, in order to receive the ends of multiple corresponding tab loops 6, as further illustrated in FIG. 3. The legs of the tab loop 6 are secured to each other and to the panel mount tabs 5, respectively, by gluing, stitching or sonic welds, as hereinafter further described, to define repetitive loop openings 7, which receive a flat ribbon drawstring 19. It will be appreciated by those skilled in the art that the number and spacing of the panel mount tabs 5 and the corresponding tab loops 6 is a matter of choice for the manufacturer, this choice being dictated, at least to some degree, by the thickness and character of the round panel 3 and the size of the ribbon drawstring 19. In any event, a sufficient number of panel mount tabs 5 and tab loops 6 must be provided in the case of a plastic round panel 3, to sufficiently support the ribbon drawstring 19 such that the ribbon drawstring ends 20 project from corresponding adjacent ones of the loop openings 7 in the respective tab loops 6, as illustrated in FIG. 1. It will be further appreciated by those skilled in the art that the sheet material 2 may be characterized by a relatively heavy material of great strength such as canvas, "rip-stop" nylon or other materials which have considerable structural integrity and therefore do not require the us of panel mount tabs 5. Under such circumstances, the tab loops 6 may be attached directly to the round panel 3 of the sheet material 2 by stitching, gluing, sonic welds or other suitable techniques, according to the knowledge of those skilled in the art.

Referring now to FIGS. 1, 4 and 7 of the drawings, in an alternative preferred embodiment of the invention the tab loops 6 ar replaced by panel slits 9 which define slit segments 10 in the round panel 3, wherein the flat ribbon drawstring 19 can be threaded through the respective panel slits 9 that are spaced around the panel periphery 4. It will be appreciated that each of the panel slits 9 must be of sufficient length and spacing and are preferably arranged in parallel pairs, to define slit segments 10 of sufficient integrity for securely engaging the ribbon drawstring 19 in sliding relationship.

Referring now to FIGS. 1, 5 and 8 of the drawing, in yet another preferred embodiment of the invention the panel periphery 4 of the round panel 3 is folded inwardly toward the center, to define a continuous drawstring channel 15 and the folded panel periphery 4 ma be provided with channel stitching 17, as illustrated in FIG. 5, to secure it in place. Alternatively, it will be appreciated by those skilled in the art that the panel periphery 4 may be glued, or, in the case of a plastic material, attached by means of a sonic weld 23, as illustrated in FIG. 8, or by other known techniques, to define the desired drawstring channel 15. The drawstring channel 15 defines a continuous channel opening 16, illustrated in FIG. 5, which is sufficiently large to accommodate a rope or cord drawstring 22 in sliding relationship.

Referring now to FIGS. 6 and 8 of the drawing, in yet another preferred embodiment of the invention the round panel 3 is configured to include multiple panel extension loops 12 projecting in spaced relationship integrally from the panel periphery 4, which panel extension loops 12 are folded back onto the main body of the round panel 3 and attached by means of loop stitching 13, as further illustrated in FIG. 6. However, as described above, it will be appreciated that the returning end of the panel extension loops 12 may be glued, or in the case of plastic, secured by means of a sonic weld 23, as illustrated in FIG. 8, or attached by other techniques known to those skilled in the art. Each of the spaced panel extension loops 12 are provided with a loop opening 7 of sufficient size to accommodate the rope or cord drawstring 22 in sliding relationship.

It will be appreciated by those skilled in the art that while the respective embodiments of the invention illustrated in FIGS. 1, 3 and 4 detail tab loops 6 and panel slits 9 for receiving a flat ribbon drawstring 19, the rope or cord drawstring 22 may be equally well used in such embodiments, so long as the loop openings 7 in the loop tabs 6 and the panel slits 9 are sufficiently large to accommodate the larger rope o cord drawstring 22. Similarly in the case of the embodiments of the invention illustrated in FIGS. 5 and 6, a flat ribbon drawstring 19 may also be substituted for the rope or cord drawstring 22 and inserted in the channel openings 16 of the drawstring channel 15 illustrated in FIG. 5, as well as the loop openings 7, in the tab loops 6 illustrated in FIG. 6.

Referring now to FIG. 2 of the drawing, in the respective embodiments of the invention illustrated in FIGS. 1 and 3–8, after the trash 24 or other material is deposited on the flat sheet material 2, deployed in planar configuration as illustrated in FIG. 1, the ribbon drawstring ends 20 are grasped by the user and the panel periphery 4 of the sheet material 2 is drawn upwardly and tightened by pulling the ribbon drawstring 19, until the trash 24 or other material is enclosed in the resulting bag configuration 8. The ribbon drawstring ends 20 can then be tied to close the periphery, or bag mouth 8*a* of the bag configuration 8 and securely contain the trash 24 or other material for storage or disposal.

It will be further appreciated by those skilled in the art that the material of construction used in the sheet material 2 of the drawstring trash container 1 can be any selected flexible material which has sufficient resiliency for planar deployment as illustrated in FIG. 1 and gathering in the bag configuration 8, illustrated in FIG. 2. Accordingly, the material may include various fabrics of any description, as well as material such as "rip-stop" nylon and various plastic compositions in varying thicknesses and sizes. Moreover, the ribbon drawstring 19 and rope or cord drawstring 22 may be of any selected diameter and constructed of any selected material, including plastic, sisal, hemp, nylon, cotton and the like. The primary criteria for each of the embodiments of the drawstring trash container 1 is that the respective tab loops 6, panel slits 9, panel extension loops 12 and drawstring channel 15 be designed to accommodate a ribbon drawstring 19 or a rope or cord drawstring 22 of sufficient size to allow easy sliding of the ribbon drawstring 19 and the rope or cord drawstring 22 in the respective loop openings 7, panel slits 9 and channel openings 16.

It is understood that while a round configuration is preferred for the plastic sheet 2, other configurations, including polygonal shapes, in non-exclusive particular, may also be used. Under these circumstances, the tab loops 6, panel slits 9, panel extension loops 12 and drawstring channel 15 may be selectively provided in the periphery 4, regardless of the shape of the periphery 4, to receive a ribbon drawstring 19 or a rope or cord drawstring 22, in the manner described above.

It will be further understood that the ribbon drawstring ends 20 can be tied in order to facilitate grasping the ribbon drawstring 19 at any point around the periphery of the sheet material 2, for convenience. Furthermore, while the loop tabs 6 and panel extension loops 12 are illustrated extended from the panel periphery 4, it will be appreciated that they can equally well be attached or relocated inwardly of the panel periphery 4.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A drawstring trash container for receiving and containing trash, comprising a flexible, round, trash-receiving sheet adapted for disposition in one plane for receiving trash, a plurality of panel mount tabs provided flat in the periphery of said sheet in spaced relationship; a plurality of drawstring-engaging members attached to said panel mount tabs, respectively; and a drawstring slidably disposed in said drawstring-engaging members for enclosing the trash in said sheet responsive to slidably extending said drawstring through said drawstring-engaging members and drawing said drawstring-engaging members together to define a trash-containing bag.

2. The drawstring trash container of claim 1 wherein said sheet is formed of a plastic material.

* * * * *